US006093004A

United States Patent [19]

Varadan et al.

[11] Patent Number: 6,093,004

[45] Date of Patent: Jul. 25, 2000

[54] PUMP/MOTOR APPARATUS USING 2-LOBE STATOR

[75] Inventors: Rajan Varadan, Sacramento, Calif.; Richard Bach, Kingsley, Mich.

[73] Assignee: Zenergy LLC, Kingsley, Mich.

[21] Appl. No.: 09/022,814

[22] Filed: Feb. 12, 1998

Related U.S. Application Data

[60] Provisional application No. 60/040,061, Feb. 12, 1997.

[51] Int. Cl.[7] ..... F01C 1/10

[52] U.S. Cl. ..... 418/48; 418/61.2; 418/178; 418/3; 418/61.3

[58] Field of Search ..... 418/61.2, 48, 178, 418/3, 61.3

[56] References Cited

U.S. PATENT DOCUMENTS

| | | | |
|---|---|---|---|
| 862,867 | 8/1907 | Eggleston | 417/472 |
| 1,371,983 | 3/1921 | Scott | 417/472 |
| 1,601,472 | 9/1926 | Gates | 417/554 |
| 1,892,217 | 12/1932 | Moineau | 418/48 |
| 2,085,115 | 6/1937 | Moineau | 418/48 |
| 2,505,136 | 4/1950 | Moineau | 418/48 |
| 2,527,670 | 10/1950 | Allen | 418/48 |
| 2,545,604 | 3/1951 | Byram . | |
| 2,615,400 | 10/1952 | Fuqua et al. | 417/554 |
| 3,084,631 | 4/1963 | Bourke | 418/48 |
| 3,164,102 | 1/1965 | Schmidt | 417/472 |
| 3,203,350 | 8/1965 | Chang | 418/48 |
| 3,286,642 | 11/1966 | Lindberg | 418/48 |
| 3,299,822 | 1/1967 | Payne | 418/48 |
| 3,307,486 | 3/1967 | Lindberg | 418/48 |
| 3,858,668 | 1/1975 | Bell . | |
| 3,938,915 | 2/1976 | Olofsson | 418/48 |
| 3,982,858 | 9/1976 | Tschirky | 418/48 |
| 4,011,917 | 3/1977 | Tiraspolsky et al. | 418/88 |
| 4,049,365 | 9/1977 | Sparks, Sr. | 417/554 |
| 4,084,925 | 4/1978 | Stroud et al. . | |
| 4,140,444 | 2/1979 | Allen | 418/48 |
| 4,221,552 | 9/1980 | Clark | 418/48 |
| 4,237,704 | 12/1980 | Varadan . | |
| 4,260,031 | 4/1981 | Jackson, Jr. | 175/107 |
| 4,260,167 | 4/1981 | Fox | 175/107 |
| 4,273,521 | 6/1981 | Baker et al. . | |
| 4,482,305 | 11/1984 | Natkai et al. . | |
| 4,546,836 | 10/1985 | Dennis et al. | 175/107 |
| 5,494,401 | 2/1996 | Varadan | 415/80 |
| 5,549,465 | 8/1996 | Varadan | 418/48 |

FOREIGN PATENT DOCUMENTS

| | | | |
|---|---|---|---|
| 67510 | 10/1975 | Australia . | |
| 961026 | 1/1975 | Canada . | |
| 2494341 | 5/1982 | France | 418/63 |
| 697466 | 9/1940 | Germany . | |
| 26 45 933 | 4/1978 | Germany . | |
| 85331 | 3/1935 | Sweden . | |
| 85331 | 11/1935 | Sweden . | |
| 909-297 | 3/1980 | U.S.S.R. . | |
| 1476-196 | 4/1989 | U.S.S.R. . | |
| 0299176 | 4/1990 | U.S.S.R. . | |
| 1109875 | 4/1968 | United Kingdom . | |
| 1 215 569 | 12/1970 | United Kingdom . | |

OTHER PUBLICATIONS

Moyno 2000 Progressing Cavity Pumps, Trade Point USA, 1995.

Tiraspolsky, W. "Hydraulic Downhole Drilling Motors" Gulf Publishing Co. 1985, "IV Positive Displacement Motors" pp. 219–222.

*Primary Examiner*—Thomas Denion
*Assistant Examiner*—Theresa Trieu
*Attorney, Agent, or Firm*—John P. O'Banion

[57] ABSTRACT

A pump or motor having a three-lobed rotor capable of being used within a hypocycloidal two-lobed stator that is designed primarily for use with a one-lobed rotor. The three-lobed rotor design allows for interchangeability with the two-lobed stator to provide for varying fluid displacements to meet particular demands. A specific application allows for the combination of both the three-lobed rotor along with a one-lobed rotor within the same two-lobed stator, thereby improving the efficiency of the pump or motor.

35 Claims, 5 Drawing Sheets

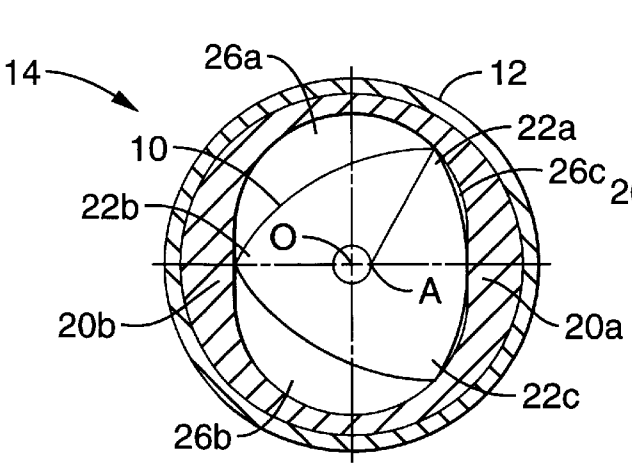
FIG. – 2A
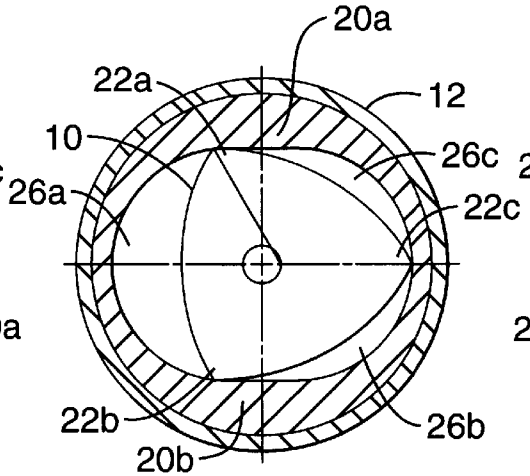
FIG. – 2B
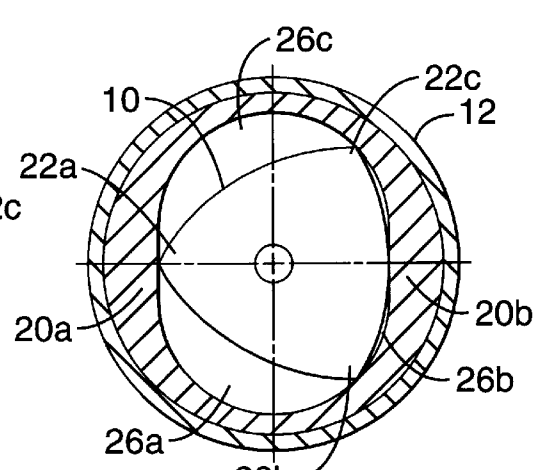
FIG. – 2C
FIG. – 2D
FIG. – 2E
FIG. – 2F

PUMP/MOTOR APPARATUS USING 2-LOBE STATOR

CROSS-REFERENCE TO RELATED APPLICATIONS

This application claims the benefit of the filing date of U.S. provisional application serial No. 60/040,061 filed on Feb. 12, 1997.

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Field of the invention

This invention pertains generally to pumps and motors, and more particularly to a positive displacement cavity pump or motor having a stator with interchangeable rotors to vary cavity displacement.

2. Description of the Background Art

Hydraulic motors and pumps are respectively used in oil fields for drilling oil wells and pumping the production fluid from the wells. One commonly used design of pump and motor is a Progressing Cavity design as taught in U.S. Pat. No. 1,892,217 and incorporated herein by reference. The Progressing Cavity design employs a rotor that rotates and nutates within a stator and is widely accepted in the oilfield industry because of its ability to produce high torque and low speeds as a motor, and its ability to withstand abrasion and develop high pressures at low shear rates as a pump. The rotational and nutational directions oppose each other, i.e. if the rotor rotates clockwise around its axis, the nutational motion around the center of the stator is counter-clockwise.

The geometry of the rotor and stator are most commonly modified hypocycloids, although other geometric shapes can also be used. The rotor consists of "n" lobes and the stator has "(n+1)" lobes, however, the minimum number of lobes in the stator is two. For example, the rotor can have four lobes while the stator has five lobes. The lobes are helical longitudinally, and the distance between two successive peaks (or valleys) is the pitch. The lead is the longitudinal distance between the same location, such as a peak, on one lobe for 360° rotation of that lobe. The lead is equivalent to the pitch multiplied by the number of lobes. In U.S. Pat. No. 1,892,217, the pitch of the rotor and the stator are the same, however, the leads are in the ratio of the number of lobes. Therefore, the lead of the stator is always greater than that of the rotor. The rotor engages in the stator offset from the center of the stator by an amount known as "eccentricity". This engagement results in multiple pockets (or chambers) for one lead of stator, and fluids are transported through these pockets. In the case of motors, fluids in these pockets act on the rotor to create a torque forcing the rotor to rotate and nutate, provided the torque generated is greater than the load's resistive torque. In the case of pumps, rotation of the rotor causes the fluid in the pocket of one lead to migrate to the pocket in the next successive lead of the stator. The direction of travel of fluid depends on the "hand" of the helix and the rotation of the rotor.

Such a design dictates that a stator with given design parameters, such as major diameter, minor diameter and lead, mesh with only one rotor. In a commonly known configuration where the stator has two lobes and the rotor has one lobe, the lead of the rotor is one-half of that of the stator, the minor diameter of the rotor is the same as that of the stator (ignoring compression), and the eccentricity of the rotor is the same as that of the stator (ignoring compression). As such, for a particular design of rotor and stator, the volume displaced by one rotation of rotor remains fixed.

A problem encountered with such "fixed" designs is the inability to change volume displacements to accommodate varying needs. As an example in pump applications, when a well is new, there is more flow into the well, and it would be more beneficial to pump as much fluid as possible for a given rotational velocity of the rotor. Over time, as the well depletes, flow to the well decreases, and the amount of fluid pumped would have to be reduced to avoid running the pump dry. Therefore, it would be advantageous to be able to change only the rotor to meet the existing well requirements without having to replace the entire pump assembly.

In applications where heavy oil is being pumped, the pump has to run at a very low rotational velocity. In such situations, it is beneficial to pump as much volume as possible from the well. In order to meet both requirements, a larger pump must be used, as long as the well casing is large enough to accommodate a larger pump. Otherwise, maximum output cannot be realized. For such situations, an interchangeable rotor that would function with the given stator, is required.

If the stator and rotor were functioning as a motor for drilling, the rotor must be capable of operating at varying rotational speeds, depending on the particular application. For high speed operation, the one-lobed rotor is used in conjunction with a two-lobed stator (1:2). For low speed operation, a "multilobe" design is used wherein the rotor has between two and nine lobes, and the stator has one more lobe than the rotor. The "multilobe" design reduces the rotational speed of the rotor as compared with the 1:2 configuration, given the same fluid volume input used to drive the rotor.

Therefore, there exists a need for a compact positive displacement pump and motor which has a three-lobed rotor capable of being used interchangeably with a one-lobed rotor within a two-lobe stator, for varying rotational speed requirements and /or fluid volume outputs or requirements. The present invention satisfies those needs, as well as others, and overcomes the deficiencies in prior technology.

BRIEF SUMMARY OF THE INVENTION

The present invention is an improvement over the "Progressing Cavity" pump or motor having a two-lobed stator and a one-lobed rotor taught in U.S. Pat. No. 1,892,217 which is incorporated herein by reference. The invention generally comprises a three-lobed rotor capable of operating within the two-lobed stator of U.S. Pat. No. 1,892,217, thus allowing for interchangeability between a one-lobed rotor and a three-lobed rotor within the same two-lobed stator or the combination of both a one-lobed rotor and a three-lobed rotor within the same two-lobed stator. The assembly can function both as a pump or a motor, depending on the specific application. The lobes on the stator and rotor can be straight or helical relative to its longitudinal axis, however use of straight lobes would also require the addition of valving and porting when the assembly is functioning either as a pump or motor. When the one-lobed rotor is used, the rotor's rotational and nutational direction oppose each other, as taught in U.S. Pat. No. 1,892,217. When the three-lobed rotor is used, the rotor rotates and nutates in the same direction within the stator, thereby reducing stress on the coupling means attached to the rotor.

An object of the invention is to provide a pump and motor having a three-lobed rotor capable of being interchangeably used within a two-lobed stator designed for a one-lobed rotor.

Another object of the invention is to provide a pump and motor having a three-lobed rotor capable of being used in combination with a one-lobed rotor within a two-lobed stator.

Another object of the invention is to provide a pump and motor capable of varying the volume of fluids displaced per given single rotation.

Still another object of the invention is to provide a pump and motor that has a rotor which rotates and nutates in the same direction within the stator.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only:

FIGS. 2A through 2F are cross-sectional views of the present invention shown at one-sixth lead intervals of rotor positions along the longitudinal axis of the present invention.

DETAILED DESCRIPTION OF THE INVENTION

Figure 1:
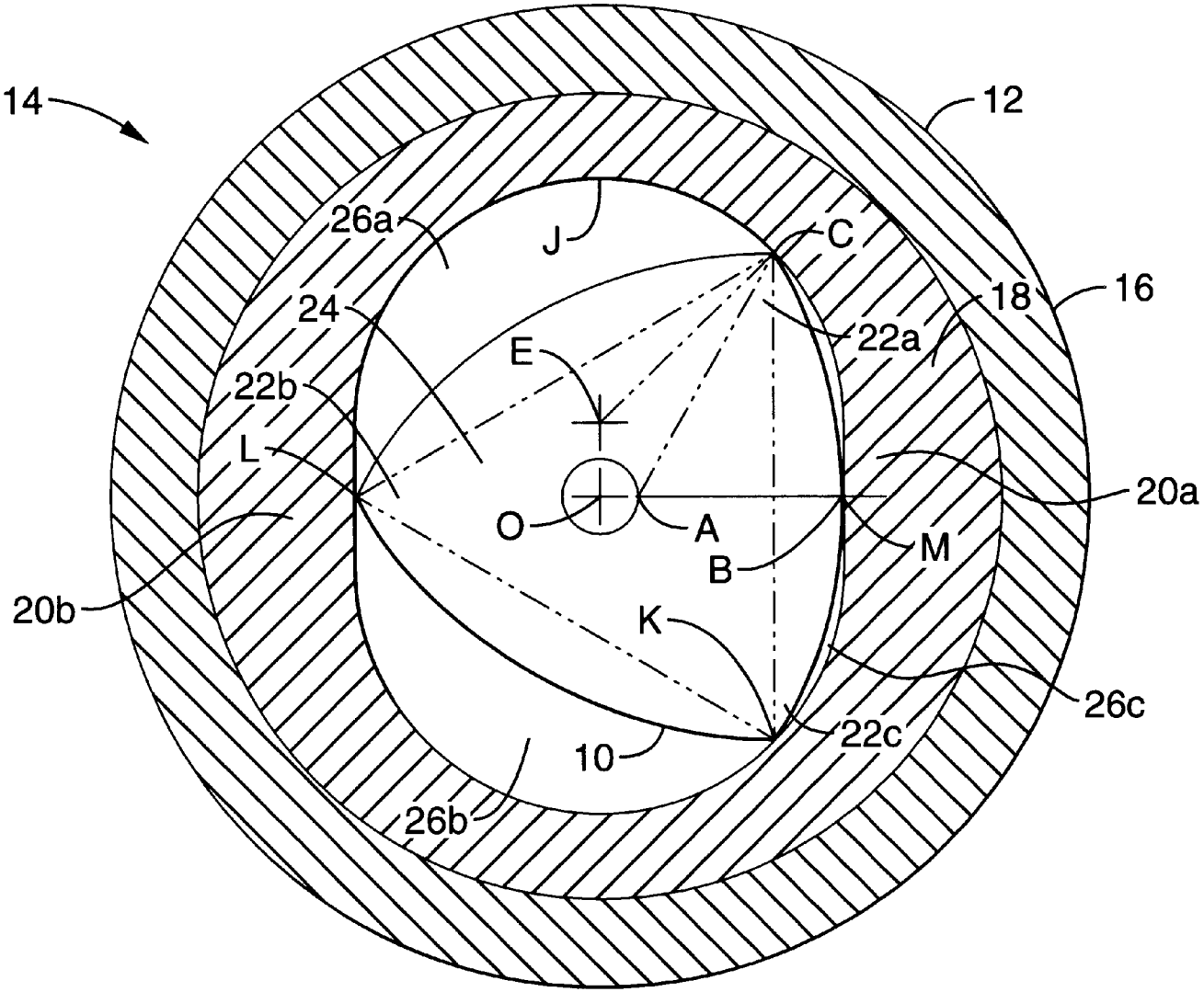
FIG. 1 is a cross-sectional view of the present invention.

Referring more specifically to the drawings, for illustrative purposes the present invention is embodied in the apparatus generally shown in FIG. 1 through FIG. 6, where like reference numerals denote like parts. It will be appreciated that the apparatus may vary as to configuration and as to details of the parts without departing from the basic concepts as disclosed herein.

Referring to FIG. 1, a three-lobed rotor 10 of the present invention is generally shown, disposed within a stator 12, forming a pump or motor apparatus 14. Stator 12 comprises a housing 16, a liner 18 and a pair of lobes 20*a*, 20*b* at equally-spaced intervals within liner 18. Lining is preferably fabricated from an elastomeric material, or other like material having compressible characteristics. Lobes 20*a*, 20*b* within stator 12 form a hypocycloidal profile modified with a rolling circle as taught in U.S. Pat. No. 1,892,217.

Rotor 10 has three lobes 22*a*, 22*b*, 22*c* with each having an apex C, L, K, respectively. Each apex is equally spaced-apart from the other at 120° intervals, thus forming an equilateral triangle 24. Point A is the axis of rotor 10 and represents the centroid of equilateral triangle 24 formed by apices C, L, K. Point O represents the centroid of stator 12. OB represents one-half of the minor diameter and OJ represents one-half of the major diameter of stator 12. OE represents two times the eccentricity of rotor 10, which is represented by OA. Dimension LM of rotor 10 is slightly larger than the minor diameter of stator 12 to allow for contact and compression between rotor 10 and stator 12. BM is the compression required for the minor diameter. CMK forms an arc having radius LM. For rotor 10 to mesh with stator 12, dimension OM must equal CE, and the major diameter of the stator can be determined from the teachings of U.S. Pat. No. 1,892,217. Apices C, L, K are joined by arcs CL, LK, KC, respectively, which have radiuses approximately equal to the minor diameter of stator 12. For example, L represents the center of arc CMK. Arc CMK is rotated 120° twice around point A to define rotor profiles between CL and LK.

In the preferred embodiment, rotor lobes 22*a*, 22*b*, 22*c* have a helical configuration, however, rotor lobes 22*a*, 22*b*, 22*c* can also have a straight configuration. In either helical or straight configuration, stator lobes 20*a*, 20*b* must be designed to mesh with rotor lobes, i.e. helical rotor lobes with helical stator lobes and straight rotor lobes with straight stator lobes. Accordingly, for a helical-lobed configuration, it can be seen that rotor 10 has a lead of 1.5 times that of the lead of stator 12. The straight lobe configuration is also applicable only when apparatus 14 is functioning either as a pump or a motor. In such applications, inlet and outlet valving (not shown) and suitable porting (not shown) are required to provide positive displacement of the fluid therein, to prevent flow between the fluid cavities 26*a*, 26*b*, 26*c* and reversal of fluid flow. The primary advantage of a straight lobe configuration is in the ease of manufacture as it does not require the precision machinery necessary to fabricate helical lobes. This would, in turn, translate to reduced manufacturing costs.

Rotor 10 is ideally fabricated from steel or like metallic material. Elastomeric liner 18 allows for compression due to rotor lobes 22*a*, 22*b*, 22*c*, thus providing a seal to fluid cavities 26*a*, 26*b*, 26*c* formed therein. Alternative, liner 18 may be fabricated from steel or like material, and rotor 10 in turn must be fabricated from an elastomeric material to allow for some rotor 10 to stator 12 compression which seal fluid cavities 26*a*, 26*b*, 26*c* formed between rotor 10 and stator 12.

Referring also to FIG. 2A through 2F, the meshing of rotor 10 having helical lobes 22*a*, 22*b*, 22*c* within stator 12 is shown. The lead of rotor 10 shown is left-hand, however, a right hand lead can also be employed. FIG. 2A through FIG. 2F represent various cross-sections of rotor 10 within stator 12 taken along the longitudinal axis of apparatus 14 at static intervals of one-sixth lead of rotor 10. It can be seen that rotor 10 meshes with stator 12 throughout all longitudinal positions of apparatus 14, and the cross-sectional areas of cavities 26*a*, 26*b*, 26*c* vary at the different longitudinal positions. In FIG. 2A, the cross-section of cavity 26*c* can be seen practically closed but begins to increase as shown in FIG. 2B. Cross-section of cavity 26*c* continues to increase as shown in FIG. 2C and FIG. 2D, wherein the largest cross-section of cavity 26*c* is occurs. Cross-section of cavity 26*c* then begins to decrease as shown in FIG. 2E and FIG. 2F, returning to a practically closed condition at a section of one-sixth rotor lead beyond FIG. 2F. A similar pattern exists for cavity 26*a* and cavity 26*b* throughout the differing cross-sectional positions of rotor 10 within stator 12.

Figure 3B:
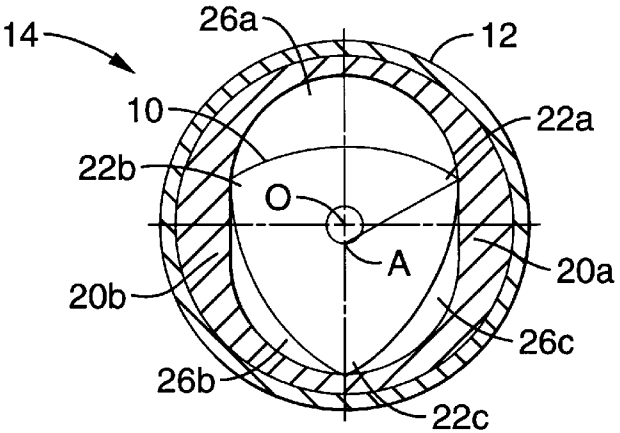
FIG. 3A through FIG. 3D are cross-sectional views of the present invention shown in FIG. 2A for 30° clockwise rotation of a rotor.
Figure 3A:
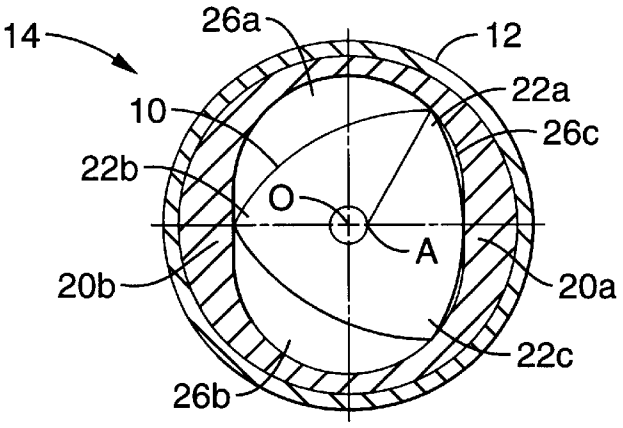
Figure 3D:
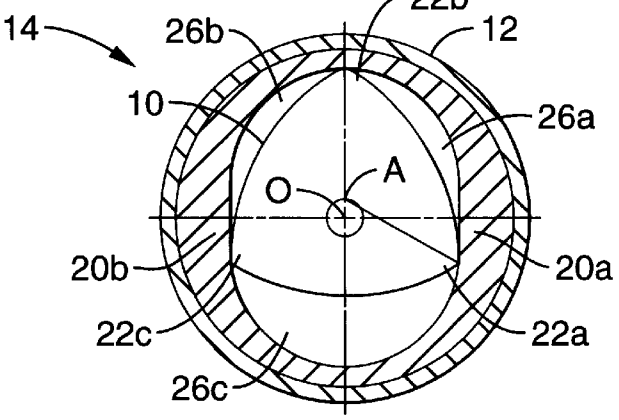
Figure 3C:
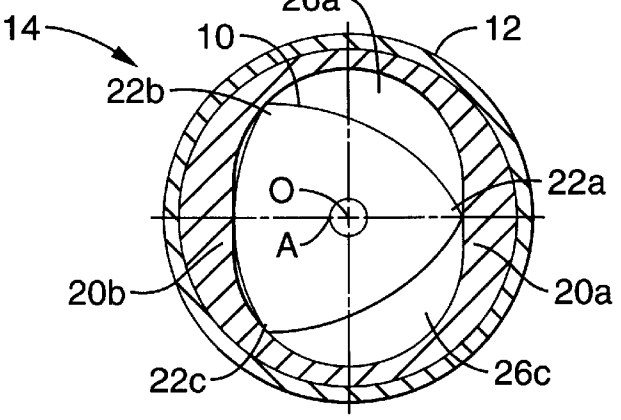

Referring also to FIG. 3A through FIG. 3D, rotor 10 and stator 12 can be seen in cross-section at the same longitudinal position throughout as shown in FIG. 2A. The dynamic meshing of rotor 10 within stator 12 is shown as rotor 10 rotates around its axis A in a clockwise direction. Beginning at FIG. 3A, for every 30° clockwise rotation of rotor 10, axis A of rotor 10 nutates 90° in a clockwise direction along a circle with center O and radius equal to eccentricity OA, as seen at FIG. 3B. A change in cross-sectional areas of cavities 26*a*, 26*b*, 26*c* can also be seen. Accordingly, FIG. 3A through FIG. 3D illustrates the same direction rotation and nutation of rotor 10 within stator 12 and that rotor 10 remains in contact with stator 12 throughout.

Figure 4:
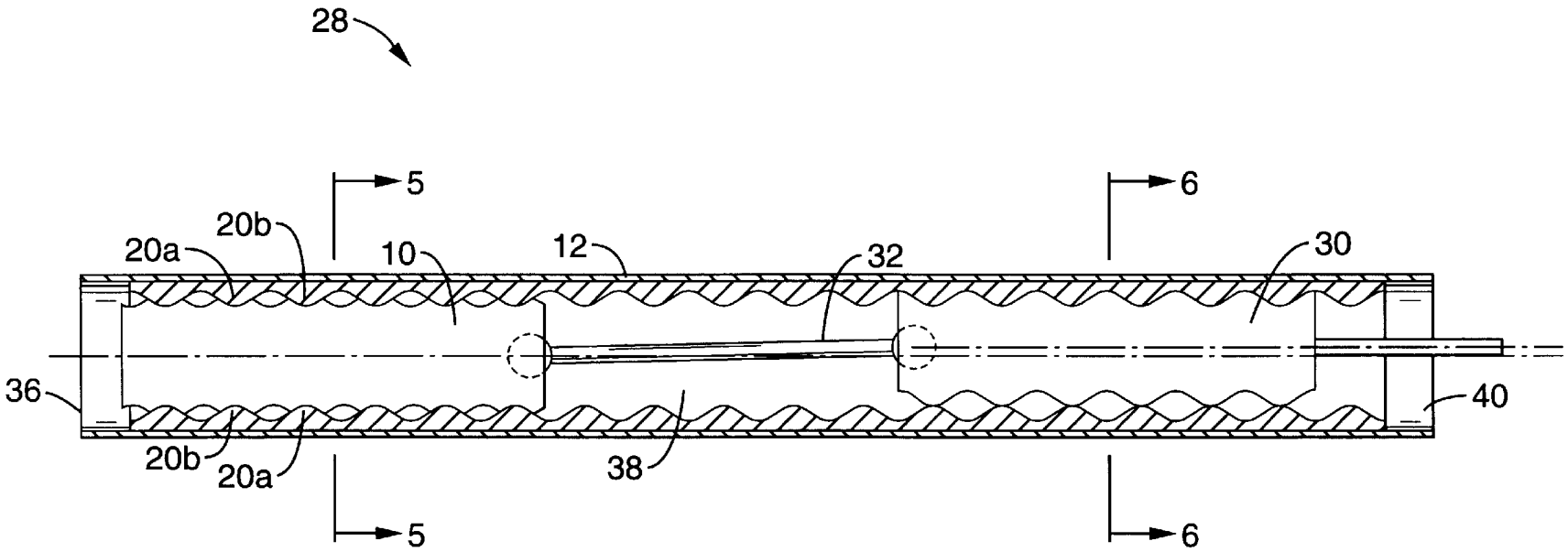
FIG. 4 is longitudinal sectional view of an alternate embodiment of the present invention.
Figure 6:
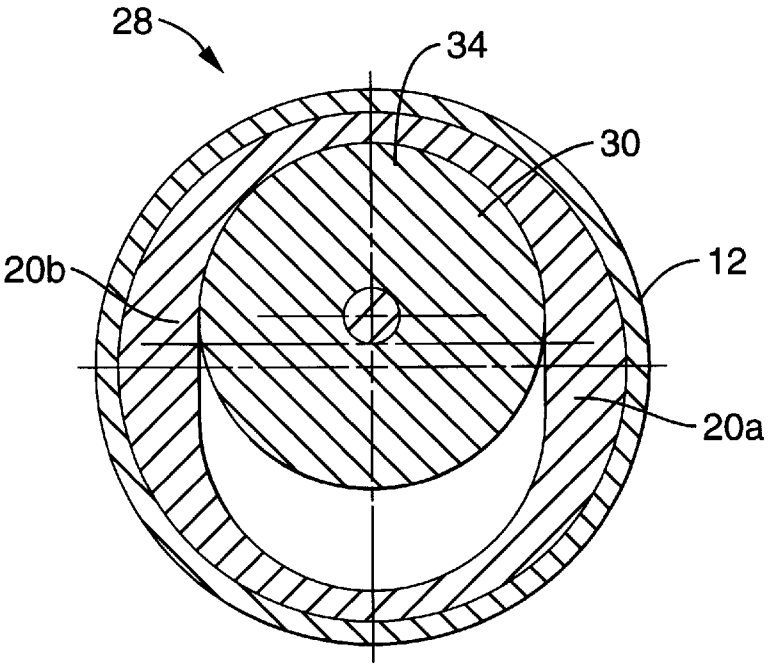
FIG. 6 is a cross-sectional view of the embodiment shown in FIG. 4 taken along line 6—6.
Figure 5:
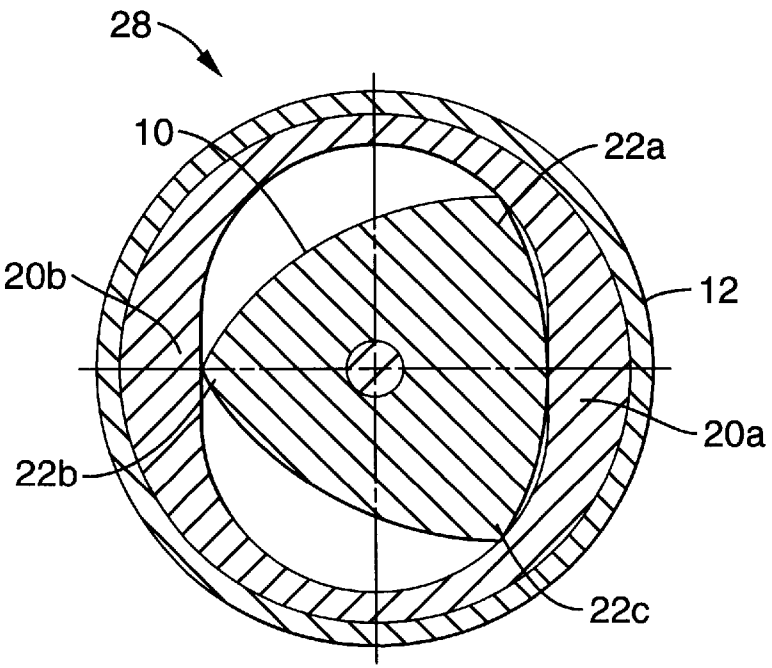
FIG. 5 is a cross-sectional view of the embodiment shown in FIG. 4 taken along line 5—5.

Referring to FIG. 4, FIG. 5 and FIG. 6, a specific application of the adaptability of the rotor 10 of the present invention is shown. In this embodiment, apparatus 28 comprises the combination of three-lobed rotor 10 and a one-lobed rotor 30 within two-lobed stator 12. Three-lobed rotor 10 and one-lobed rotor 30 are attached by a drive means 32, such as a flexible shaft, universal joint, pony rod or like means capable of transferring rotational energy between rotor 10 and rotor 30. Both rotors 10, 30 rotate in a the same direction within stator 12, however, one-lobed rotor 30 nutates in an opposing direction from three-lobed rotor 10, as taught in U.S. Pat. No. 1,892,217. Apparatus 28 is ideally suited in applications involving compressible fluids or fluids consisting of a combination liquid/gas mixture. The varying cavity displacements between lobes 22*a*, 22*b*, 22*c* of three-lobed rotor 10 and lobe 34 of one-lobed rotor 30 allows for a greater volume of fluid to be displaced and compressed. Apparatus 28 would essentially function as a two-stage compressor, wherein inlet end 36 receives the fluid which first goes through three-lobed rotor 10, where the fluid is displaced along the longitudinal axis of apparatus 28. As the fluid is displaced, three-lobed-rotor 10 also compresses the fluid, thereby providing a denser fluid which is passed to open cavity 38, and then received by one-lobed rotor 30. Because the fluid received by one-lobe rotor 30 is denser, the fluid displacement and output of one-lobe rotor 30 through the outlet 40 is increased, thereby increasing the overall efficiency of apparatus 28 over a single rotor design as taught in U.S. Pat. No. 1,892,217.

Accordingly, it will be seen that this invention provides for a three-lobed rotor capable of being used within a two-lobed stator designed for use with a one-lobed rotor, either singly or in combination with a one-lobed rotor to offer greater versatility and/or efficiency to oil well pumps and motors. Although the description above contains many specificities, these should not be construed as limiting the scope of the invention but as merely providing illustrations of some of the presently preferred embodiments of this invention. Thus the scope of this invention should be determined by the appended claims and their legal equivalents.

What is claimed is:

1. A positive displacement pump or motor, comprising:

(a) a rotor having three lobes protruding therefrom, each said lobe including an apex;

(b) a rotor surface formed between each said apex, each said surface being generally convex; and (c) a stator having a pair of lobes disposed therein, said rotor disposed within said stator such that said rotor remains in contact with said stator during rotation and nutation of said rotor within said stator;

(d) wherein said rotor rotates and nutates in a same direction within said stator.

2. An apparatus as recited in claim 1, wherein said stator lobes form a hypocycloidal profile modified with a rolling circle.

3. An apparatus as recited in claim 1, wherein said stator lobes and said rotor lobes have a helical configuration.

4. An apparatus as recited in claim 1, wherein said stator lobes and said rotor lobes have a straight configuration.

5. An apparatus as recited in claim 1, wherein said stator further comprises an elastomeric lining.

6. An apparatus as recited in claim 1, further comprising:

(a) a one-lobe rotor disposed within said stator, said one-lobe rotor having a lobe that remains in contact with said stator during rotation and nutation of said one-lobe rotor within said stator; and (b) connecting means between said three-lobe rotor and said one-lobe rotor for transmitting rotational energy between said one-lobe rotor and said three-lobe rotor.

7. An apparatus as recited in claim 1, wherein said apices form an equilateral triangle.

8. A positive displacement pump or motor, comprising:

(a) a rotor having three lobes protruding therefrom, each said lobe including an apex;

(b) a rotor surface formed between each said apex, each said surface being generally convex; and (c) a stator having a pair of lobes disposed therein, said rotor disposed within said stator such that cavities are formed therebetween;

(d) wherein said rotor rotates and nutates in a same direction within said stator.

9. An apparatus as recited in claim 8, wherein said stator lobes form a hypocycloidal profile modified with a rolling circle.

10. An apparatus as recited in claim 8, wherein said stator lobes and said rotor lobes have a helical configuration.

11. An apparatus as recited in claim 8, wherein said stator lobes and said rotor lobes have a straight configuration.

12. An apparatus as recited in claim 8, wherein said stator further comprises an elastomeric lining.

13. An apparatus as recited in claim 8, further comprising:

(a) a one-lobe rotor disposed within said stator, said one-lobe rotor having a lobe that remains in contact with said stator during rotation and nutation of said one-lobe rotor within said stator; and (b) connecting means between said three-lobe rotor and said one-lobe rotor for transmitting rotational energy between said one-lobe rotor and said three-lobe rotor.

14. An apparatus as recited in claim 8, wherein said apices form an equilateral triangle.

15. A positive displacement pump or motor, comprising:

(a) a rotor having three lobes protruding therefrom, each said lobe including an apex, said apices forming an equilateral triangle;

(b) a rotor surface formed between each said apex, each said surface being generally convex;

(c) a stator having a pair of lobes disposed therein, said rotor disposed within said stator such that cavities are formed therebetween;

(d) a one-lobe rotor disposed within said stator, said one-lobe rotor having a lobe that remains in contact with said stator during rotation and nutation of said one-lobe rotor within said stators; and (e) connecting means between said three-lobe rotor and said one-lobe rotor for transmitting rotational energy between said one-lobe rotor and said three-lobe rotor.

16. An apparatus as recited in claim 15, wherein said stator lobes form a hypocycloidal profile modified with a rolling circle.

17. An apparatus as recited in claim 15, wherein said stator lobes and said rotor lobes have a helical configuration.

18. An apparatus as recited in claim 15, wherein said stator lobes and said rotor lobes have a straight configuration.

19. An apparatus as recited in claim 15, wherein said stator further comprises an elastomeric lining.

20. A positive displacement pump or motor, comprising:

(a) a rotor having three lobes protruding therefrom, each said lobe including an apex, said apices forming an equilateral triangle;

(b) a rotor surface formed between each said apex, each said surface being generally convex;

(c) a stator having a pair of lobes disposed therein, said rotor disposed within said stator such that said rotor remains in contact with said stator during rotation and nutation of said rotor within said stator;

(d) a one-lobe rotor disposed within said stator, said one-lobe rotor having a lobe that remains in contact with said stator during rotation and nutation of said one-lobe rotor within said stator; and (e) connecting means between said three-lobe rotor and said one-lobe rotor for transmitting rotational energy between said one-lobe rotor and said three-lobe rotor.

21. An apparatus as recited in claim 20, wherein said stator lobes form a hypocycloidal profile modified with a rolling circle.

22. An apparatus as recited in claim 20, wherein said stator lobes and said rotor lobes have a helical configuration.

23. An apparatus as recited in claim 20, wherein said stator lobes and said rotor lobes have a straight configuration.

24. An apparatus as recited in claim 20, wherein said stator further comprises an elastomeric lining.

25. A positive displacement pump or motor, comprising:

(a) a rotor having three lobes protruding therefrom, each said lobe including an apex, said apices forming an equilateral triangle;

(b) a rotor surface formed between each said apex, each said surface being generally convex;

(c) a stator having a pair of lobes disposed therein, said lobes forming a hypocycloidal profile modified with a rolling cylinder, said rotor disposed within said stator such that cavities are formed therebetween;

(d) a one-lobe rotor disposed within said stator, said one-lobe rotor having a lobe that remains in contact with said stator during rotation and nutation of said one-lobe rotor within said stator; and (e) connecting means between said three-lobe rotor and said one-lobe rotor for transmitting rotational energy between said one-lobe rotor and said three-lobe rotor.

26. An apparatus as recited in claim 25, wherein said stator lobes and said rotor lobes have a helical configuration.

27. An apparatus as recited in claim 25, wherein said stator lobes and said rotor lobes have a straight configuration.

28. An apparatus as recited in claim 25, wherein said stator further comprises an elastomeric lining.

29. A positive displacement pump or motor, comprising:

(a) a rotor having three lobes protruding therefrom, each said lobe including an apex;

(b) a rotor surface formed between each said apex, each said surface being generally convex;

(c) a stator having a pair of lobes disposed therein, said lobes forming a hypocycloidal profile modified with a rolling cylinder, said rotor disposed within said stator such that cavities are formed therebetween;

(d) a one-lobe rotor disposed within said stator, said one-lobe rotor having a lobe that remains in contact with said stator during rotation and nutation of said one-lobe rotor within said stator; and (e) connecting means between said three-lobe rotor and said one-lobe rotor for transmitting rotational energy between said one-lobe rotor and said three-lobe rotor.

30. An apparatus as recited in claim 29, wherein said stator lobes and said rotor lobes have a helical configuration.

31. An apparatus as recited in claim 29, wherein said stator lobes and said rotor lobes have a straight configuration.

32. An apparatus as recited in claim 29, wherein said stator further comprises an elastomeric lining.

33. An apparatus as recited in claim 29, wherein said apices form an equilateral triangle.

34. A positive displacement pump or motor, comprising:

(a) a rotor having three lobes protruding therefrom, each said lobe including an apex;

(b) a rotor surface formed between each said apex, each said surface being generally convex;

(c) a stator having a pair of lobes disposed therein, said rotor disposed within said stator such that said rotor remains in contact with said stator during rotation and nutation of said rotor within said stator;

(d) a one-lobe rotor disposed within said stator, said one-lobe rotor having a lobe that remains in contact with said stator during rotation and nutation of said one-lobe rotor within said stator; and (e) connecting means between said three-lobe rotor and said one-lobe rotor for transmitting rotational energy between said one-lobe rotor and said three-lobe rotor.

35. A positive displacement pump or motor, comprising:

(a) a rotor having three lobes protruding therefrom, each said lobe including an apex;

(b) a rotor surface formed between each said apex, each said surface being generally convex;

(c) a stator having a pair of lobes disposed therein, said rotor disposed within said stator such that cavities are formed therebetween;

(d) a one-lobe rotor disposed within said stator, said one-lobe rotor having a lobe that remains in contact with said stator during rotation and nutation of said one-lobe rotor within said stator; and (e) connecting means between said three-lobe rotor and said one-lobe rotor for transmitting rotational energy between said one-lobe rotor and said three-lobe rotor.

* * * * *